US010288362B2

(12) United States Patent
Beaurepaire et al.

(10) Patent No.: US 10,288,362 B2
(45) Date of Patent: May 14, 2019

(54) MANIFOLD FOR A HEAT EXCHANGER

(71) Applicant: Valeo Systemes Thermiques, Le Mesnil Saint Denis (FR)

(72) Inventors: Elise Beaurepaire, Le Mans (FR); Philippe Doucet, Sable-sur-Sarthe (FR); Marc Herry, Le Mans (FR); Julien Veron, Le Mans (FR); Patrick Hoger, Ferce-sur-Sarthe (FR)

(73) Assignee: Valeo Systems Thermiques, le Mesnil Saint Denis (FR)

( * ) Notice: Subject to any disclaimer, the term of this patent is extended or adjusted under 35 U.S.C. 154(b) by 322 days.

(21) Appl. No.: 15/037,120

(22) PCT Filed: Oct. 23, 2014

(86) PCT No.: PCT/EP2014/072771
§ 371 (c)(1),
(2) Date: Aug. 4, 2016

(87) PCT Pub. No.: WO2015/071069
PCT Pub. Date: May 21, 2015

(65) Prior Publication Data

US 2016/0334173 A1 Nov. 17, 2016

(30) Foreign Application Priority Data

Nov. 18, 2013 (FR) ..... 13 61294

(51) Int. Cl.
*F28F 9/02* (2006.01)
*B21D 39/06* (2006.01)
*B21D 53/08* (2006.01)

(52) U.S. Cl.
CPC ..... *F28F 9/0212* (2013.01); *B21D 39/06* (2013.01); *B21D 53/08* (2013.01); *F28F 2275/04* (2013.01); *F28F 2275/045* (2013.01)

(58) Field of Classification Search
CPC .... F25B 39/00; F25B 39/04; F25B 2400/121; F25B 2339/046; F25B 2339/042;
(Continued)

(56) References Cited

U.S. PATENT DOCUMENTS 230,815 A * 8/1880 Puffer ..... F28F 9/0212 165/176
4,825,941 A * 5/1989 Hoshino ..... B21C 37/22 165/110
(Continued)

FOREIGN PATENT DOCUMENTS

EP 0 798 530 A1 10/1997
JP 2000-130984 A 5/2000
(Continued)

OTHER PUBLICATIONS

International Search Report issued in PCT/EP2014/072771 dated Dec. 23, 2014 (3 page).
(Continued)

*Primary Examiner* — Ljiljana V Ciric
(74) *Attorney, Agent, or Firm* — Osha Liang LLP

(57) ABSTRACT

A manifold for a heat exchanger for a motor vehicle that includes a tubular wall and at least one separating partition partitioning the manifold. The tubular wall may have at least one slot formed over a portion of the tubular wall's cross section and may allow for the insertion of said separating partition. The separating partition may include an internal part inserted into the tubular wall, and the internal part may have a periphery with a first portion and a second portion situated facing the tubular wall. The second portion may be adjacent to at least one deformation of the tubular wall, such that an internal cross section of the tubular wall corresponds to the perimeter of the partition along the second portion.

13 Claims, 1 Drawing Sheet

Figure 1:
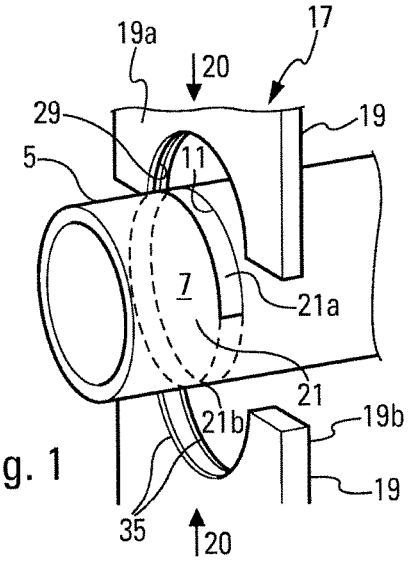

(58) Field of Classification Search
CPC ..... F25B 2500/01; F25B 43/006; F25B 2400/16; F25B 2339/044; B60H 1/3227
See application file for complete search history.

(56) References Cited

U.S. PATENT DOCUMENTS 4,936,381 A * 6/1990 Alley ..... F28F 9/0212 138/94.3
5,042,578 A 8/1991 Tanabe
5,209,292 A * 5/1993 Arneson ..... F28F 9/0212 165/174
5,226,490 A * 7/1993 Ryan ..... F28F 9/182 165/173
5,329,995 A * 7/1994 Dey ..... F28F 9/0212 165/153
5,348,083 A * 9/1994 Hosoya ..... B21D 53/02 165/173
5,573,061 A * 11/1996 Chiba ..... F28D 1/05341 165/174
5,582,239 A * 12/1996 Tsunoda ..... B21D 53/02 165/176
5,586,600 A * 12/1996 Cribari ..... F28F 9/0212 165/173
5,782,295 A * 7/1998 Kato ..... F28F 9/0212 165/174
5,894,886 A * 4/1999 Chiba ..... F28D 1/035 165/173
5,896,754 A * 4/1999 Balthazard ..... B60H 1/3229 165/132
6,546,997 B2 * 4/2003 Inaba ..... F25B 39/04 165/110
7,059,398 B2 * 6/2006 Jung ..... F28F 9/0212 165/173
7,156,165 B2 * 1/2007 Ohata ..... F28D 1/05391 165/144
2004/0050537 A1 * 3/2004 Kim ..... F25B 39/04 165/115
2004/0261983 A1 * 12/2004 Hu ..... F28D 1/0443 165/148
2006/0118287 A1 6/2006 Higgins
2018/0216892 A1 * 8/2018 Kaneko ..... B60H 1/00335

FOREIGN PATENT DOCUMENTS

KR 10-2012-0076754 A 7/2012
KR 10-2012-0120593 A 11/2012

OTHER PUBLICATIONS

Vi/ritten Opinion of the International Searching Authority issued in PCT/EP2014/072771 dated Dec. 23, 2014 (7 pages).

* cited by examiner

MANIFOLD FOR A HEAT EXCHANGER

The invention relates to a manifold for a heat exchanger, as well as a heat exchanger comprising such a manifold.

Applications of the invention will be found in the field of motor vehicles, in particular in the form of battery coolers or even heat exchangers such as condensers and/or evaporators of air conditioning circuits. However, further applications of the invention are also conceivable.

It is known to produce heat exchangers having a plurality of fluid circulation cycles passing through the exchanger and to this end to subdivide the manifolds of the heat exchangers by separating partitions.

In particular, condensers provided with so-called internal manifold separating partitions are known. Said partitions are inserted through one end of the manifold and crimped onto said manifold, in particular by deformation of the wall of the manifold, which ensures temporary support of the partition on the manifold before brazing and permits a sealed connection of the partition on the wall of the manifold to be guaranteed after brazing.

However, the manifolds are also provided with through-orifices for the tubes, said orifices being provided with flanges protruding toward the interior of the manifold. The use of internal partitions thus requires a succession of complex steps of recessing the flanges and assembling the partitions to the wall of the manifold, which results in an increase in production costs, in particular in the case of the use of internal dies for producing the flanges.

Also known are so-called external manifold separating partitions, which are inserted into cut-outs of the wall of the manifold. Said partitions permit flanges to be produced for the passage of tubes in the manifold using said internal dies, prior to the assembly of the partitions on the wall of the manifold, which simplifies production. Said partitions may be held in position prior to assembly, see KR 20120076754 and KR 20120120593, by the insertion by force of the partitions onto the wall of the manifold, in particular due to the engagement of the overthickness of their periphery on the wall of the manifold. Said partitions require very small dimensional differences between the partitions and the walls of the manifolds to ensure the seal after brazing. The manifolds, however, are not always calibrated to a precise geometry which impairs the assembly and leads to a risk of reducing the seal, even after brazing.

The object of the invention is to remedy entirely or partially these drawbacks and proposes a manifold for a heat exchanger, in particular for a motor vehicle, said manifold comprising a tubular wall and at least one separating partition partitioning the manifold, said tubular wall comprising at least one slot formed over a portion of its cross section and able to allow an insertion of said separating partition, the separating partition comprising an internal part inserted in the tubular wall, said internal part having a periphery provided with a first portion, in particular situated facing the slot, and a second portion situated facing the tubular wall, said second portion being adjacent to at least one deformation of the tubular wall such that an internal cross section of the tubular wall corresponds to the perimeter of the partition along said second portion.

Thus, the wall of the manifold is calibrated or recalibrated by said deformation and establishes continuous contact with the perimeter of said second portion, during preassembly of the manifold, such that no space exists between said second portion and the tubular wall. The subsequent assembly of the heat exchanger by brazing, in particular of this second portion to the tubular wall of the manifold, is in this manner fully sealed. In other words, any passage of fluid is prevented, not only to the exterior but also on both sides of the partition.

According to further features of the invention which may be taken in combination or individually:

- said tubular wall is cylindrical, in particular having a diameter of less than 15 mm, preferably less than or equal to 12 mm; it is in particular at this level of dimensions that the formation of flanges in the manifold causes deformations of the section of the tubes, which the invention remedies, due to the recalibration of said tubular wall,
- said first portion extends over the length of the slot and the second portion extends over a complementary part of the first portion over the periphery of the tubular wall,
- said second portion is of circular-arc shape, preferably along a radius equivalent to an internal radius of the tubular wall,
- the slot extends over an angular section of the angular wall, preferably along a section in the vicinity of a diametrical section of the tubular wall,
- the width of said slot is slightly greater than that of the separating partition, by approximately 0.05 to 0.15 mm, such that the subsequent assembly of the separating partition to the tubular wall in the region of the slot, during brazing of the corresponding heat exchanger, permits a satisfactory level of sealing to be ensured,
- said deformation of the tubular wall comprises two annular beads bordering said second portion,
- said separating partition comprises two opposing shoulders, each capable of being applied to a terminal edge of the slot,
- said first portion of the separating partition is shaped so as to come into contact with the periphery of the tubular wall in the region of said slot,
- said first portion of the separating partition comprises a part protruding from the tubular wall in the region of said slot,
- said protruding part comprises a transverse flattened portion, in particular perpendicular to a central plane of the slot, said flattened portion permitting a position of the partition bearing against the tubular wall to be promoted,
- said protruding part comprises two opposing rectilinear edges, on both sides of the flattened portion, in particular parallel to said central plane of the slot, said rectilinear edges permitting in particular an angular guidance and/or retention of the separating partition on the tubular wall,
- said separating partition is fixedly locked to the tubular wall, in particular clamped against said slot,
- said partition and/or the tubular wall comprises a local deformation in the region of the slot, in particular capable of clamping the partition in the slot and retaining it fixedly on the tubular wall of the manifold,
- said local deformation is an annular overthickness, for example in the form of a bead, of the partition and extends at an angle over the length of the slot,
- said slot is cut out to dimensions less than the diameter of the tubular wall, such that when the separating partition is mounted by force in the slot it is held trapped in the tubular wall,
- said slot and/or separating partition is provided with two opposing, for example substantially diametrical, notches and said lateral wall comprises shaped portions penetrating said notches.

The invention further relates to a heat exchanger, in particular for the cooling of batteries, comprising at least one manifold as disclosed above.

Said manifold could comprise a plurality of through-orifices for the tubes of the exchanger, said orifices being bordered by flanges for connection to the tubes. Said flanges could have a longitudinal configuration parallel to the axis of the manifold.

The invention further relates to a method for preassembly of a tubular wall of the manifold for a heat exchanger, in particular for a motor vehicle, and a separating partition partitioning the manifold, said tubular wall comprising at least one slot formed on a portion of its section and capable of permitting an insertion of said separating partition, the separating partition comprising an internal part capable of being inserted into the tubular wall, via the slot, said internal part having a periphery provided with a first portion, in particular designed to be brought opposite the slot, and a second portion designed to be brought opposite the tubular wall, the method comprising the following steps:

the insertion of the partition into the slot, and deformation of the tubular wall, such that an internal section of the tubular wall corresponds to the perimeter of said second portion.

Advantageously, said die may comprise two parallel circular ribs, configured for the deformation of the tubular wall along two annular beads bordering said second portion.

According to different features of said method, which could be taken in combination or individually:

the mounting of the assembly of the tubular wall and the separating partition is carried out on a pressing jig, the separating partition being introduced into the slot and the tubular wall being retained opposite by a die of the jig, the use of the jig is implemented such that the first portion is pushed in the direction of the tubular wall and the second portion deforms said tubular wall.

Advantageously, the separating partition and the tubular wall are configured such that when the use of the jig is completed, said separating partition is locked to the tubular wall.

Thus, as said slot is cut out to dimensions less than the diameter of the tubular wall, for example, the separating partition is mounted by force into the slot by the jig and it is held radially clamped on the tubular wall when the use of the jig is completed.

As a variant, since said separating partition is provided with two opposing, for example substantially diametrical, notches the separating partition is mounted in the slot by the jig and when the use of the jig is completed, it is held radially clamped on the tubular wall by shaped portions formed in said tubular wall, in engagement in the notches.

According to a further variant, said separating partition comes into contact with the external periphery of the tubular wall by its first portion. Said jig may then comprise a punch part provided with a rib, or even pointed parts, capable of being applied against said first portion, such that during the use of the jig the first portion is deformed and trapped and/or clamped against the slot and the partition is locked to the tubular wall.

Figure 2:
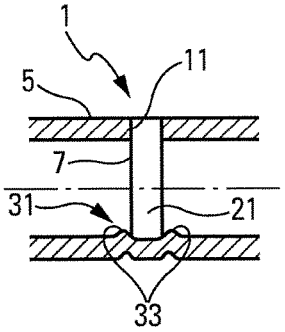
Figure 3:
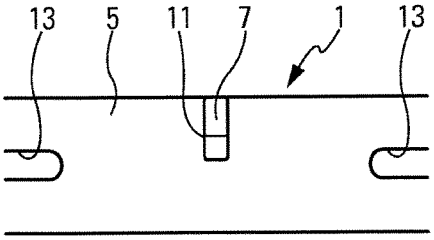
Figure 4:
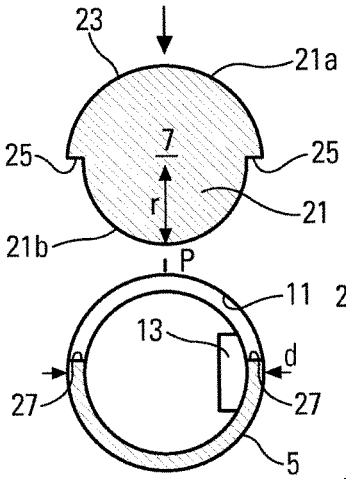
Figure 5:
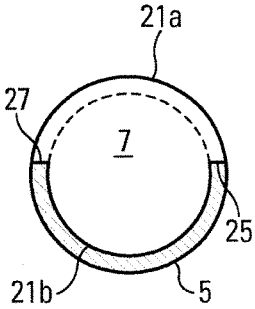
Figure 6:
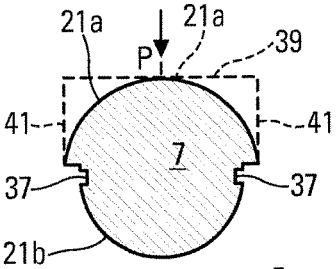
Figure 6:
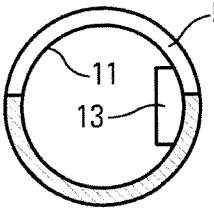
Figure 7:
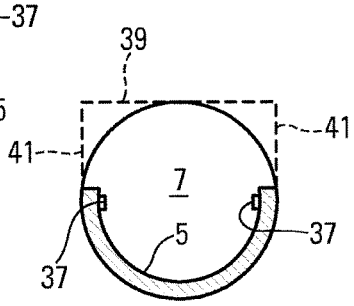
Figure 8:
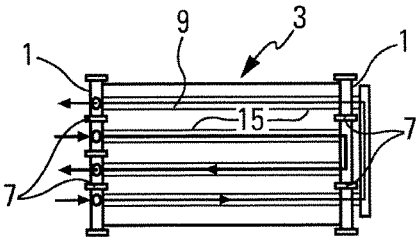

Further features and advantages of the invention will become apparent from reading the following description of embodiments shown by way of illustration, with reference to the figures of the accompanying drawings, in which:

FIG. 1 is a partial perspective view illustrating a manifold according to the invention during preassembly, FIG. 2 is a partial axial sectional view of the preassembled manifold of FIG. 1, FIG. 3 is a partial elevation of the preassembled manifold of FIG. 1, FIG. 4 is a cross-sectional view of the manifold of FIG. 1 during mounting, FIG. 5 is a sectional view of the preassembled manifold of FIG. 4, FIG. 6 is a cross-sectional view of a manifold according to a variant of the invention during mounting, FIG. 7 is a sectional view of the preassembled manifold of FIG. 6, and FIG. 8 shows a heat exchanger for a battery according to the invention.

As illustrated, the invention relates to a manifold 1 of a heat exchanger 3, in particular for a battery of a motor vehicle. The manifold 1 comprises a tubular wall 5 and one or more separating partitions 7 permitting a circulation of a heat exchange fluid 9 to be oriented, in this case in a plurality of cycles, inside the heat exchanger. Said tubular wall is obtained, for example, by the folding and welding of a side wall in one piece, along a line parallel to the longitudinal axis of the manifold.

The separating partition 7 is of the so-called external type, i.e. it is configured so as to be introduced inside the manifold via a slot 11, formed on an angular, in particular a substantially diametrical, portion of the tubular wall. The slot 11 is thus capable of receiving said separating partition 7 in order to partition the manifold 1. Said slot 11 is in this case formed at right angles to the tubular wall 5 but it could also be inclined relative to a plane transverse to the tubular wall.

The tubular wall 5 is cylindrical, in particular having a diameter of less than 15 mm, preferably less than or equal to 12 mm. This wall is also provided with through-orifices for the tubes 15 of the heat exchanger. Said through-orifices are bordered by flanges 13 for connection to said tubes 15. The flanges 13 are in this case oblong, of longitudinal extent parallel to the longitudinal axis of the tubular wall. At this level of relatively small dimensions of the manifold, the formation of the flanges 13 deforms the tubular wall, the perimeter thereof between two adjacent flanges significantly deviating from a circular shape.

The manifold 1 is shown in FIG. 1 during preassembly on a pressing jig 17. The tubular wall 5 and the separating partition 7 are arranged between the pressing elements 19 of the jig so as to be pushed toward one another along the arrows 20.

The pressing element facing the partition 7 is a punch 19*a* whilst the opposing pressing element is a die 19*b*.

The separating partition 7 is planar and generally disk-shaped. It comprises an internal part 21 designed to be inserted into the tubular wall 5, said internal part 21 having a periphery provided with a first portion 21*a* opposite the slot 11 and a second complementary portion 21*b* opposite the tubular wall 5.

In other words, the first portion 21*a* and the second portion 21*b* extend continuously from one to the other over the entire periphery of the tubular wall 5.

The first portion 21*a*, see also FIGS. 4 and 5, comprises an upper circular-arc shaped face 23 provided to come into contact with the periphery of the tubular wall 5, after preassembly. This face 23 constitutes a bearing face opposite the pushing element 19*a* of the jig.

The first portion 21*a* comprises, in particular, two opposing shoulders 25, each capable of being applied against a terminal edge 27 of the slot 11.

The second portion 21*b* is arranged against the tubular wall 5 which is applied by its external face against the opposing die 19*b*.

According to the invention, the preassembled manifold 1 is such that said second portion 21*b* is adjacent to at least one deformation 31 of the tubular wall 5 such that an internal section of the tubular wall 5 along said second portion 21*b* corresponds to the perimeter of said second portion 21*b*.

Thus, the tubular wall 5, the internal circumference thereof being influenced in particular by the prior production of said flanges 13, is calibrated or recalibrated dimensionally by said deformation 31 in order to follow the perimeter of said second portion 21*b*. In this manner any space or clearance which might exist between the separating partition and the tubular wall is prevented, in particular on this second portion 21*b* facing the tubular wall 5. The subsequent assembly by brazing of the exchanger 3, comprising the preassembled manifold, is thus perfectly sealed, in particular on said second portion 21*b*, as the closeness of contact between the parts has been reinforced.

Said second portion 21*b* in this case is shaped with a circular-arc shaped perimeter, having the radius r equivalent to that of the tubular wall 5, in particular as it was before the formation of said flanges 13, such that the deformation 31 recalibrates the tubular wall 5 to its original radius.

It should be mentioned that the width of the slot 11, greater than that of the separating partition 7 by approximately 0.05 to 0.15 mm, as indicated above, permits during assembly of the exchanger 3, the subsequent brazing of the separating partition 7 to the tubular wall 5, more specifically the first portion 21*a* in the region of the slot 11, to be carried out with a level of sealing which is equivalent to that of the second portion 21*b* relative to the tubular wall 5.

Advantageously, said second portion 21*b* is bordered by two annular beads 33 corresponding to said deformation 31 of the tubular wall. This deformation 31 results from the fact that the die 19*b* could comprise, as in this case, two parallel circular ribs 35, capable of deforming the tubular wall 5 along the two annular beads 33. Said beads 33 in this case are located on both sides of the second portion 21*b*.

This being the case, the punch 19*a* is provided here over its periphery with a central rib 29, capable of being applied against said bearing face 23, such that during the use of the jig, the bearing face 23 is deformed by the rib 29 so as to be applied against the slot 11. This deformation, not shown, may be small, since the width of said slot 11 is only slightly greater than that of the separating partition 7 by approximately 0.05 to 0.15 mm. The deformation is local, in particular annular, for example in the form of a bead, and extends opposite the slot 11 over the length thereof. When the preassembly is complete, the partition 7 is trapped and/or clamped against the slot 11 so as to lock the partition 7 to the tubular wall 5.

The manifold obtained is thus able to be handled without the risk of the partition escaping from the tubular wall via said slot, in particular until it is subsequently mounted on the exchanger. Such a result could also be obtained in a different manner.

For example, the slot 11 may be cut out to dimensions less than the external diameter d, preferably slightly less than the diameter d, as illustrated in FIG. 4, such that the separating partition 7 may be mounted by force in the slot 11 as shown in FIG. 5. This partition 7 is thus held trapped during the preassembly of the partition 7 to the tubular wall 5. It is thus no longer necessary to deform the first portion 21*a* by the punch 19*a*, as in the aforementioned example, in order to fix the partition 7 to the tubular wall 5.

As a variant, as illustrated in FIG. 6, said separating partition 7 is provided with two opposing, substantially diametrical, notches 37 such that when the separating partition 7 is mounted in the slot 11, FIG. 7, it is held trapped on the tubular wall 5 by projections formed on the tubular wall 5, in engagement in the notches 37.

It should be mentioned that the separating partition 7 may also be shaped so as to protrude from the tubular wall 5, in particular by the first portion 21*a* protruding in the region of the slot 11, as shown in dashed lines in FIGS. 6 and 7.

The protruding part 21*a* in this case comprises a flattened portion 39 perpendicular to a central plane P of the slot 11 and two opposing rectilinear edges 41, on both sides of the flattened portion 39, parallel to said central plane P of the slot. The flattened portion 39 constitutes a bearing face for the pushing element 19*a* of the jig. The rectilinear edges 41 permit, in particular, a guidance and/or angular retention of the separating partition 7 during the use of the jig 17, in particular during the pressing movement of the jig, for the purpose of said deformation of the tubular wall 5. The rectilinear edges make it possible, in particular, to ensure that the partition is correctly located on the tubular wall by each of the shoulders 25.

The method of preassembling the manifold according to the invention comprises the following steps:

- the mounting of the assembly of the tubular wall 5 and the separating partition 7 on the pressing jig 17, and
- the use of the pressing jig 17 such that the separating partition 7 introduced into the slot 11 is pushed by the pushing element 19*a* by its bearing face 23, 39, in the direction of the tubular wall 5 which is opposingly retained by the die 19*b* of the jig.

The second portion 21*b* is then applied against the tubular wall 5 which is deformed so that its internal section or periphery corresponds to the perimeter of said second portion 21*b*.

When the use of the jig is completed, the tube is recalibrated and said separating partition 7 is locked to the tubular wall 5 by being held trapped or clamped on the tubular wall 5.

This locking may be ensured by trapping the partition 7 on the slot 11, by deforming the bearing face 23 opposite the slot 11 or trapping the periphery of the partition 7 on the perimeter of the tubular wall 5 or even by engaging in notches 37 of the partition on the tubular wall, as mentioned above.

The assembly of the heat exchanger 3 comprising the preassembled manifold 1 illustrated in FIG. 8 is advantageously implemented by a brazing operation consisting, in particular, of heating the parts of the preassembled exchanger up to a temperature which is greater than the melting temperature of an additional metal, the fixing of the parts being implemented by diffusion, by the capillary action of said additional metal on the surface of the parts.

The invention provides a manifold with an external partition for a heat exchanger, in particular for a motor vehicle, which is simple to assemble and which has a high level of sealing.

The invention claimed is:

1. A manifold for a heat exchanger for a motor vehicle, said manifold comprising:

- a tubular wall; and
- at least one separating partition partitioning the manifold,
- said tubular wall comprising at least one slot formed over a portion of a cross section of the tubular wall, the slot allowing for insertion of said separating partition, the separating partition comprising an internal part inserted into the tubular wall, said internal part having a periphery provided with a first portion and a second portion situated facing the tubular wall, said second portion being adjacent to at least one deformation of the tubular wall such that an internal cross section of the tubular wall corresponds to a perimeter of the separating partition along the second portion, wherein the at least one deformation recalibrates the tubular wall to an original radius corresponding to the perimeter of the partition along the second portion.

2. The manifold as claimed in claim 1, in which said tubular wall is cylindrical having an external diameter d greater than zero and less than or equal to 12 mm.

3. The manifold as claimed in claim 1, in which said first portion extends over the length of the slot and the second portion extends over a complementary part of the first portion over the periphery of the tubular wall.

4. The manifold as claimed in claim 1, in which the slot extends over a diametrical section of the tubular wall.

5. The manifold as claimed in claim 1, in which said deformation of the tubular wall comprises two annular beads bordering said second portion.

6. The manifold as claimed in claim 1, in which said annular beads are shaped portions of the tubular wall.

7. The manifold as claimed in claim 1, in which said first portion of the separating partition comes into contact with the external periphery of the tubular wall in the region that is proximal to said slot.

8. The manifold as claimed in claim 1, in which said first portion of the separating partition comprises a part protruding from the tubular wall in the region that is proximal to said slot.

9. The manifold as claimed in claim 8, in which said protruding part comprises a flattened portion perpendicular to a central plane P of the slot, said protruding part comprising two opposing rectilinear edges, on both sides of the flattened portion parallel to said central plane P of the slot.

10. The manifold as claimed in claim 1, in which said periphery of the separating partition is fixedly locked to the perimeter of the tubular wall.

11. The manifold as claimed in claim 10, in which said partition and/or the tubular wall comprises a local deformation in the region that is proximal to the slot.

12. The manifold as claimed in claim 1, in which said slot that is formed over a portion of the tubular wall's cross section is cut out to dimensions less than the diameter d of the external tubular wall, such that when the separating partition is mounted by force in the slot the separating partition is held trapped on the tubular wall.

13. The manifold as claimed in claim 1, in which said separating partition is provided with two opposing, for example substantially diametrical, notches and said lateral wall comprises shaped portions penetrating said notches.

* * * * *